United States Patent [19]

Massey

[11] 4,095,645

[45] Jun. 20, 1978

[54] LINEAR UNIFORM HEAT WRAP CONTROL

[75] Inventor: William A. Massey, Mount Holly, N.J.

[73] Assignee: Molins Machine Company, Inc., Cherry Hill, N.J.

[21] Appl. No.: 758,611

[22] Filed: Jan. 12, 1977

[51] Int. Cl.[2] ..... F28D 11/02

[52] U.S. Cl. ..... 165/13; 34/52; 165/1; 236/15 BC; 432/45; 432/51

[58] Field of Search ..... 165/12, 13; 236/15 BC, 236/15 BE; 432/45, 51, 54; 34/48, 52

[56] References Cited

U.S. PATENT DOCUMENTS

| | | | |
|---|---|---|---|
| 2,421,283 | 5/1947 | Offen | 432/45 X |
| 3,004,880 | 10/1961 | Lord | 34/154 X |
| 3,078,587 | 2/1963 | Huck | 34/48 |
| 3,697,722 | 10/1972 | Furvichi | 432/45 X |
| 3,946,800 | 9/1974 | Evans | 165/1 |

*Primary Examiner*—Charles J. Myhre
*Assistant Examiner*—Margaret A. LaTulip
*Attorney, Agent, or Firm*—Seidel, Gonda & Goldhammer

[57] ABSTRACT

A heat wrap control for a preheater in a paperboard corrugator adjusts the amount of wrap of a moving web about a heated drum as a linear function of web speed to effect uniform heat transfer to the web.

10 Claims, 2 Drawing Figures

LINEAR UNIFORM HEAT WRAP CONTROL

BACKGROUND OF THE INVENTION

The present invention is directed to a heat wrap control. In particular, the invention is directed to a heat wrap control which effects uniform heat transfer to a moving web by adjusting the wrap of the web about a heated drum as a linear function of web speed.

In a corrugator for making corrugated paperboard, there is provided a double facer machine and at least one single facer machine. Each of said machines processes two webs. At least one web processed by each machine is preheated by peripheral contact with a heated drum. The heated drum and associated elements constitute a preheater. Preheating the web reduces thermal demands on the single facer and double facer. This permits operation at higher speeds. The preheater also reduces any tension variations that might result from out-of-round rolls, and it helps to remove wrinkles from the webs.

A preheater for controlling the wrap of a web is disclosed in U.S. Pat. No. 3,946,800 in the name of Donald J. Evans assigned to the assignee herein. The patent is incorporated herein by reference for the purpose of describing the background against which the present invention is made. The preheater includes a frame supporting a drum. The drum is supported for rotation about its longitudinal axis and is constructed to transmit heat to a moving web in surface contact therewith. A pair of idler rollers are supported by the frame for movement about the periphery of the drum for effecting wrap of the web over the drum surface. A drive means causes the pair of rollers to move between minimum and maximum wrap positions to vary the heat transmitted from the drum to the web.

At a control panel, an operator selects a web speed which is indicative of the lowermost position of the idler rollers. The lowermost position of the rollers corresponds to maximum heat transfer to the web. The position of the idler rollers is automatically adjusted relative to the drum axis as a linear function of the web speed to maintain uniform heat transfer to the web.

A voltage sensitive relay is coupled across a pair of adjustable potentiometers. One such potentiometer is part of the speed setting means of a drive power unit for the single facer machine or the double facer machine. The other potentiometer is coupled to a reversible motor to effect peripheral movement of the idler rollers. The voltage sensitive relay detects fluctuations in speed of the single facer or double facer machine. If the speed of the machine decreases, the voltage sensitive relay causes the idler rollers to move upward to decrease the wrap of the web about the heated drum. As a result, the amount of heat transferred to the web decreases. If the speed of the machine increases, the voltage sensitive relay causes the idler rollers to move downward. As a result, the amount of heat transferred to the web increases. Thus, the position of the idler rollers is adjusted as a function of a reference speed signal indicative of the speed of the machine.

It has been found that there is a non-linear relationship between the amount of wrap of the web about the drum as a function of adjustment of the idler rollers in the "low wrap" region. This is caused by the geometrical relationship between the idler rollers and the heated drum.

Accordingly, accurate control of heat transferred to the web is not possible in the "low wrap" region. The present invention recognizes this problem and provides a novel solution therefor.

BRIEF SUMMARY OF THE INVENTION

A heat wrap control for providing uniform heat transfer to a moving web while automatically compensating for non-linearities in the amount of web wrap effected in response to web speed. A set point means selectively provides a set point heat signal indicative of the amount of heat to be transferred to a moving web. A speed sensing means provides a reference speed signal indicative of the web speed. Control means operatively associated with the set point means and speed sensing means controls the wrap of the web about the preheater drum to effect uniform heat transfer to the web. The control means includes linear means for controlling the web wrap as a linear function of web speed.

An advantage of the present invention is that it provides linear web wrap control as a function of web speed.

Another advantage of the invention is that the control of web wrap is highly accurate over full range of control.

A further advantage is that the invention utilizes relatively inexpensive and readily available digital components for achieving the desired control.

Other advantages appear hereinafter.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
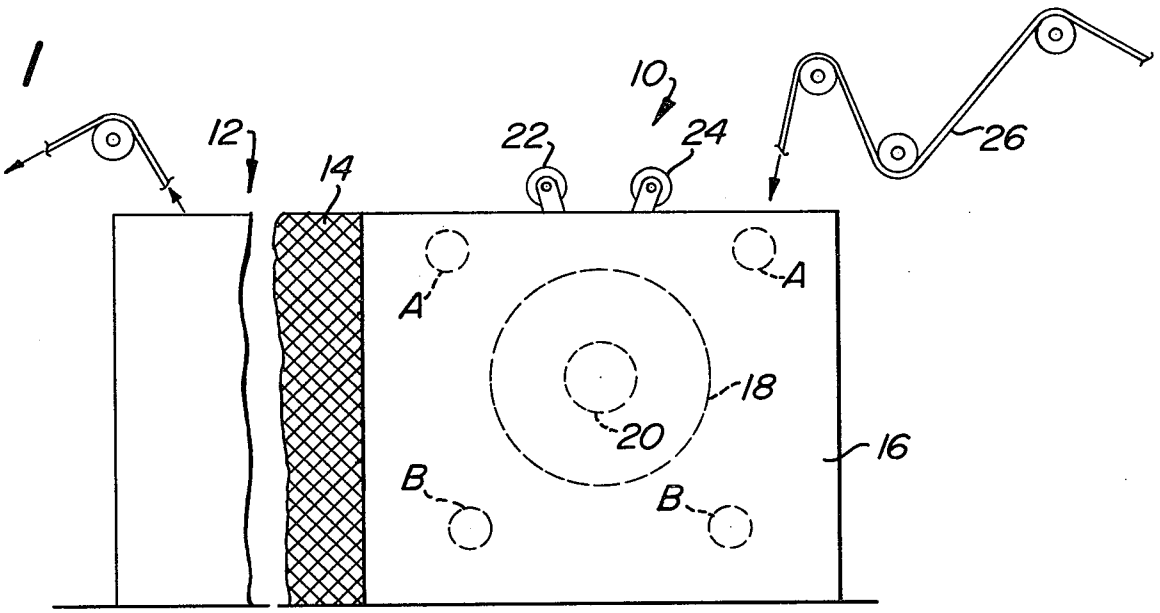
FIG. 1 is a side elevation view of a preheater.

Referring to the drawings in detail, wherein like numerals indicate like elements, there is shown in FIG. 1 a preheater which may be used in conjunction with a single facer or double facer machine. For the purpose of disclosing a preferred embodiment herein, the preheater is assumed to be operatively associated with a single facer machine. The preheater as shown in FIG. 1 includes two preheaters 10 and 12 in tandem with a guard 14 therebetween. Since the preheaters are identical, only preheater 10 will be described in detail.

The preheater 10 includes end frames 16 which rotatably support a drum 18 for rotation about its longitudinal axis. The journals which support the drum 18 may be hollow so that steam or some other fluid such as heated oil may be introduced into the drum 18 to heat the same. Other means for heating the drum such as electrical resistors may also be utilized.

Associated with the drum 18, there are provided idler rollers 22 and 24 pivotable about the periphery thereof. The idler rollers 22 and 24 have a thread-up position as shown in FIG. 1. Each of the idler rollers may be moved to position A which designates the minimum or "zero" wrap position. Also, the idler rollers may have any one of a variety of intermediate positions down to position B which is the maximum wrap position. As web speed decreases, the amount of wrap also decreases to maintain constant heat transfer to the moving web. The moving web is indicated as 26 in FIG. 1.

The position of the idler rollers is varied by means of a reversible motor which drives the rollers through appropriate gearing as disclosed in U.S. Pat. No. 3,946,800 incorporated herein by reference.

Figure 2:
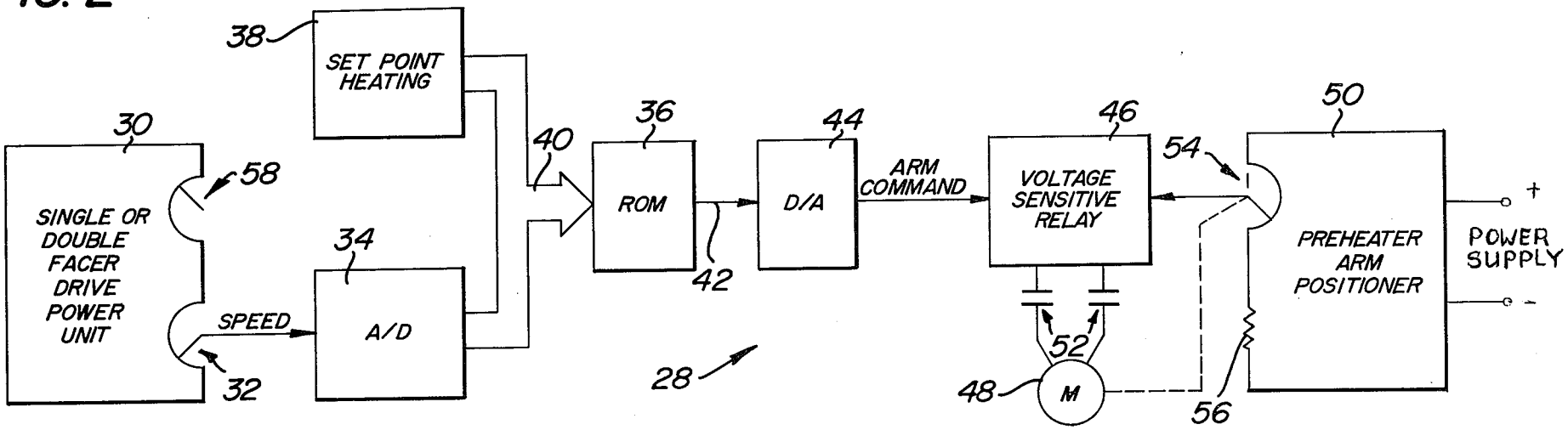
FIG. 2 is a block diagram of the heat wrap control of the present invention.

Referring to FIG. 2, there is shown a heat wrap control according to the present invention designated generally as 28. A single facer drive power unit 30 includes a motor operated potentiometer 32. The motor operated potentiometer 32 provides a reference speed signal indicative of web speed.

The motor operated potentiometer 32 is connected to an analog to digital converter 34. The analog to digital converter 34 converts the reference speed signal provided by potentiometer 32 to a digital multi-bit signal for purposes of addressing a read-only memory 36 as described more fully hereinafter.

A set point heating circuit 38 comprising thumb wheel switches or the like is selectively adjusted by the operator to provide a set point heat signal which is a digital multi-bit signal also used for addressing read-only memory 36. The digital signals provided by set point heating circuit 38 and analog to digital converter 34 are combined to form a single digital word at the input 40 to the read-only memory. The read-only memory 36 contains digital information for compensating for the non-linear relationship between the web speed and the amount of web wrap effected by adjustment of the position of the idler rollers. In effect, the read-only memory is utilized to introduce offsetting non-linearities to linearize the relationship between web wrap and web speed.

Information accessed in the read-only memory appears as a digital signal at the input 42 to digital to analog converter 44. The digital to analog converter generates an "arm command" signal for purposes of controlling a voltage sensitive relay 46 associated with reversible motor 48 and preheater arm positioner 50. The reversible motor 48 drives the idler rollers to effect unifor heat wrap control as a linear function of web speed. The voltage sensitive relay includes normally open contacts 52 connected to the reversible motor. The reversible motor is also mechanically coupled to motor operated potentiometer 54 in the preheater arm positioner.

The preheater arm positioner includes a trimmer resistor 56 in series with motor operated potentiometer 54 and the power supply. By the foregoing arrangement, motor operated potentiometer 54 is mechanically driven by motor 48 to provide a voltage that is the desired function of the position of the idler rollers.

The direction of rotation of motor 48 is dictated by the relationship of the signals communicated to voltage sensitive relay 46 by digital to analog converter 44 and motor operated potentiometer 54. The potentiometer 58 in the single facer driver power unit 30 provides a manual adjustment of the voltage across resistor 56 to etablish the correct relationship between wiper voltage and single facer speed.

In operation, the single facer drive power unit 30 sets the speed of the single facer machine hence web speed. The motor operated potentiometer 32 generates a reference speed signal indicative of web speed. The reference speed signal is used to control reversible motor 48. The set point heating circuit 38 and analog to digital converter 34 address the read-only memory 36. The output of the read-only memory, therefore, is a function of the web speed, as indicated by the reference speed signal, and the desired amount of heat to be transferred to the web as indicated by the set point heat signal. The output of the read-only memory introduces a non-linearity in the relationship between idler roller position and web speed by means of the "arm command" signal. Any difference between the "arm command" signal and the signal provided by motor operated potentiometer 54 causes voltage sensitive relay 46 to close one of te contacts 52 to activate reversible motor 48. Reversible motor 48 causes the idler rollers to move between positions A and B or vice versa. As the idler rollers move, motor operated potentiometer 54 is driven by motor 48 to null out the difference in signals appearing at the inputs to the voltage sensitive relay. The non-linearity introduced by the read-only memory offsets the non-linearity between web wrap and position of the idler rollers, particularly in the "low wrap" region. As a result, web wrap is made a linear function of web speed to enable uniform heat transfer to the web over the full range of control.

Each of the electrical components described above are relatively inexpensive and readily available. The read-only memory may be an integrated circuit programmed to provide the offsetting non-linearities referred to above. The voltage sensitive relay may be a solid state relay. Equivalent devices may be substituted without exceeding the purview of the invention.

The present invention may be embodied in other specific forms without departing from the spirit or essential attributes thereof and, accordingly, reference should be made to the appended claims, rather than to the foregoing specification as indicating the scope of the invention.

What is claimed is:

1. A heat wrap control, comprising:

set point means for selectively providing a set point heat signal indicative of the amount of heat to be transferred to a moving web, speed sensing means for providing a reference speed signal indicative of the speed of the web, and control means operatively associated with said set point means and said speed sensing means for controlling wrap of the web about a preheater drum to effect uniform heat transfer to the web.

2. The heat wrap control according to claim 1 wherein said control means includes linear means for controlling the web wrap as a linear function of web speed.

3. The heat wrap control according to claim 2 wherein said linear means includes a read-only memory having information stored therein which is accessible as a function of said set point heat and reference speed signals, and means for adjusting the web wrap as a function of said information.

4. A heat wrap control, comprising:

set point means for selectively providing a digital set point heat signal indicative of the amount of heat to be transferred to a moving web, speed sensing means for providing a digital reference speed signal indicative of the speed of the web, and control means operatively associated with said set point means and said speed sensing means for controlling wrap of the web about a preheater drum as a linear function of the web speed to effect constant heat transfer to the web.

5. The heat wrap control according to claim 4 wherein said control means includes a read-only memory having information stored therein which is accessible as a function of said set point heat and reference speed signals, and means for adjusting the web wrap as a function of said information.

6. A heat wrap control, comprising:

set point means for selectively providing a digital set point signal indicative of the amount of heat to be transferred to a moving web, speed sensing means for providing a digital reference speed signal indicative of the speed of the web, and a read-only memory having information stored therein which is accessible as a function of said set point heat and reference speed signals, and means operatively associated with said read-only memory for adjusting the web wrap as a linear function of web speed to effect uniform heat transfer to the web.

7. A method of controlling the amount of heat transferred to a moving web, comprising:

selectively providing a set point heat signal indicative of the amount of heat to be transferred to a moving web, providing a reference speed signal indicative of the speed of the web, and controlling wrap of the web about a heated drum to effect uniform heat transfer to the web as a function of said set point heat and reference speed signals.

8. A method according to claim 7 wherein said controlling step includes controlling the web wrap as a linear function of web speed.

9. A method of controlling the amount of heat transferred from a heated drum to a moving web, comprising:

selectively providing a digital set point heat signal indicative of the amount of heat to be transferred to a moving web, providing a digital reference speed signal indicative of the speed of the web, and controlling wrap of the web about the heated drum as a linear function of the web speed to effect uniform heat transfer to the web.

10. A method of controlling the amount of heat transferred from a heated drum to a moving web, comprising:

selectively providing a digital set point heat signal indicative of the amount of heat to be transferred to a moving web, providing a digital reference speed signal indicative of the speed of the web, and accessing a read-only memory having information stored therein as a function of said set point heat and reference speed signals, and adjusting the web wrap about the drum as a linear function of web speed to effect uniform heat transfer to the web in response to the accessed read-only memory information.

* * * * *